US010465332B2

(12) United States Patent
Simon et al.

(10) Patent No.: US 10,465,332 B2
(45) Date of Patent: Nov. 5, 2019

(54) CONDENSER TUMBLE DRYER COMPRISING A TEMPERATURE SENSOR, AND METHOD FOR THE OPERATION THEREOF

(71) Applicant: BSH HAUSGERÄTE GmbH, München (DE)

(72) Inventors: Marcus Simon, Falkensee (DE); Johannes Eichstädt, Milower Land (DE); Maike Blanken, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 237 days.

(21) Appl. No.: 15/509,585

(22) PCT Filed: Aug. 27, 2015

(86) PCT No.: PCT/EP2015/069589
§ 371 (c)(1),
(2) Date: Mar. 8, 2017

(87) PCT Pub. No.: WO2016/037856
PCT Pub. Date: Mar. 17, 2016

(65) Prior Publication Data

US 2017/0260683 A1 Sep. 14, 2017

(30) Foreign Application Priority Data

Sep. 11, 2014 (DE) ..... 10 2014 218 254

(51) Int. Cl.
*F26B 19/00* (2006.01)
*D06F 58/28* (2006.01)
(Continued)

(52) U.S. Cl.
CPC ..... *D06F 58/28* (2013.01); *D06F 58/02* (2013.01); *D06F 58/206* (2013.01); *D06F 58/24* (2013.01);
(Continued)

(58) Field of Classification Search
CPC ..... D06F 58/28; D06F 58/24; D06F 58/203; D06F 58/02; D06F 58/206;
(Continued)

(56) References Cited

U.S. PATENT DOCUMENTS 5,651,192 A 7/1997 Horwitz
5,755,041 A 5/1998 Horwitz
(Continued)

FOREIGN PATENT DOCUMENTS

CN 102768412 A 11/2012
DE 697 23 622 T2 6/2004
(Continued)

OTHER PUBLICATIONS

International Search Report for PCT/EP2015/069589 dated Nov. 16, 2015, 6 pages.
(Continued)

*Primary Examiner* — John P McCormack
(74) *Attorney, Agent, or Firm* — Nixon & Vanderhye P.C.

(57) ABSTRACT

The invention relates to a condenser tumble dryer with a drum for articles to be dried, a drive motor for the drum, a process air duct, a process air blower, a heating and cooling system for the process air, a temperature sensor and a control device. The temperature sensor is an infrared telescope and is arranged to simultaneously measure heat radiation from at least two components of the condenser tumble dryer which are to be monitored. The invention also relates to a method for operating a condenser tumble dryer of said type.

16 Claims, 3 Drawing Sheets

Figure 1:
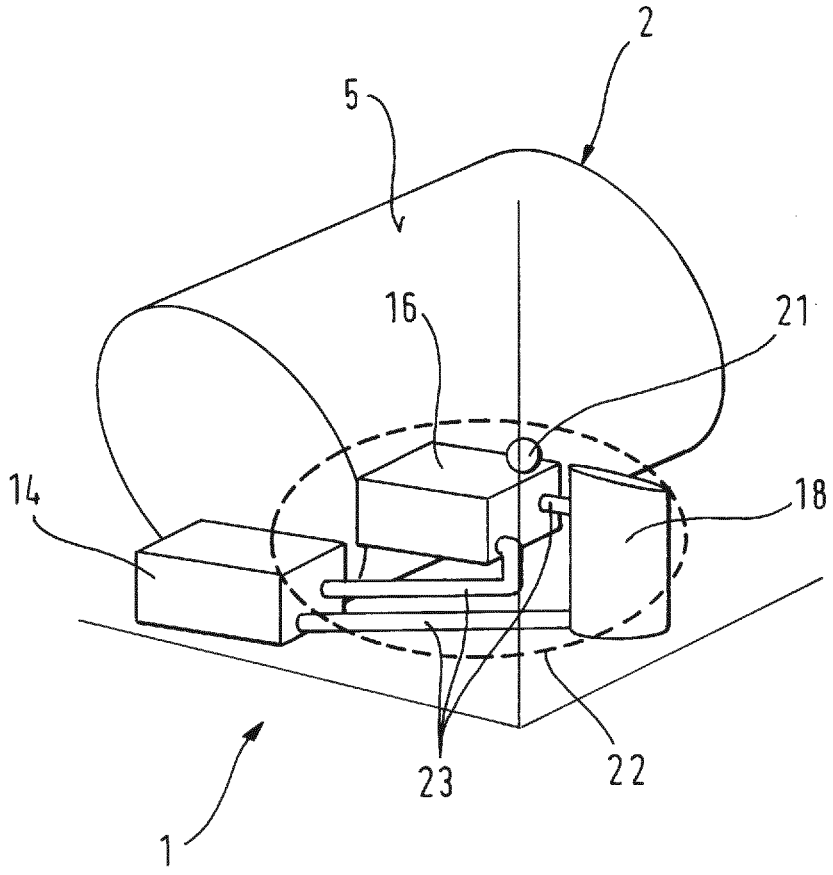

(51) Int. Cl.
*D06F 58/02* (2006.01)
*D06F 58/20* (2006.01)
*D06F 58/24* (2006.01)

(52) U.S. Cl.
CPC ..... *D06F 2058/287* (2013.01); *D06F 2058/2845* (2013.01); *D06F 2058/2858* (2013.01)

(58) Field of Classification Search
CPC ..... D06F 2058/2806; D06F 2058/2858; D06F 2058/2854; D06F 2058/287
USPC ..... 34/89
See application file for complete search history.

(56) References Cited

U.S. PATENT DOCUMENTS 8,973,286 B1 * 3/2015 Hyde ..... D06F 58/206 34/595
9,580,860 B2 * 2/2017 Bellinger ..... D06F 58/28
2005/0218790 A1 * 10/2005 Blumel ..... G02B 27/0955 313/498
2012/0186305 A1 * 7/2012 Taniguchi ..... D06F 25/00 68/19
2015/0178101 A1 * 6/2015 Krishnaswamy ... G06F 9/44505 713/100

FOREIGN PATENT DOCUMENTS

DE 10 2005 055411 5/2007
DE 10 2013 205311 10/2014
WO WO 2014/127842 8/2014

OTHER PUBLICATIONS

International Preliminary Report on Patentability for PCT/EP2015/069589 dated Nov. 7, 2016, 27 pages.

* cited by examiner

CONDENSER TUMBLE DRYER COMPRISING A TEMPERATURE SENSOR, AND METHOD FOR THE OPERATION THEREOF

This application is the U.S. national phase of International Application No. PCT/EP2015/069589 filed Aug. 27, 2015 which designated the U.S. and claims priority to DE Patent Application No. 10 2014 218 254.9 filed 11 Sep. 2014, the entire contents of each of which are hereby incorporated by reference.

The invention relates to a condenser tumble dryer with a drum for articles to be dried, a drive motor for the drum, a process air duct, a process air blower, a heating and cooling system for the process air, a temperature sensor and a control facility. The invention also relates to a method for operating such a condenser tumble dryer.

The invention relates in particular to a condenser tumble dryer (herein also shortened to tumble dryer or dryer) with a drum for articles to be dried, a drive motor for the drum, a process air duct, a process air blower, a heating and cooling system for the process air, a temperature sensor and a control facility as well as a preferred method for its operation.

In a condenser tumble dryer air (referred to as process air) is conducted by a blower by way of a heater into a drying chamber in the form of a drum containing damp laundry articles. The hot air absorbs moisture from the laundry articles to be dried. After passing through the drum, the then moist warm process air is conducted into a heat exchanger, which is generally preceded by a lint filter. The moist process air is cooled in said heat exchanger (e.g. air to air heat exchanger or heat sink of a heat pump) so the water contained in the moist process air condenses. The condensed water is then generally collected in a suitable container and the cooled and dried air is fed back to the heater, which can optionally be the heat source of a heat pump, and then to the drum.

This drying operation is sometimes very energy-intensive as energy from the cooling air flow heated as the process air cools in the heat exchanger can be lost during the process. Such energy loss can be significantly reduced by using a heat pump. In a condenser tumble dryer fitted with a heat pump the warm, moisture-laden process air is essentially cooled in a heat sink of the heat pump, where the heat extracted from the process air is used for example to evaporate a coolant used in the heat pump circuit. The heat absorbed in the heat sink is transported to the heat source within the heat pump and emitted again there, in some instances at a higher temperature than the temperature at the heat sink. In a heat pump that operates with a coolant as the heat transporting agent, with the coolant being evaporated in the heat sink and condensed in the heat source, the evaporated, gaseous coolant passes by way of a compressor to the heat source, which can be referred to here as the condenser. The condensing of the gaseous coolant here causes heat to be released, which is used to heat the process air before it enters the drum. The condensed coolant finally flows through a throttle unit back to the evaporator, with the throttle unit serving to lower the internal pressure in the coolant so that it can evaporate in the evaporator as it absorbs heat again. The heat pump, which is operated in such a manner with a circulating coolant, is also referred to as a "compressor heat pump". Other models of heat pump are also known.

The traditionally used air to air heat exchanger and the electric heater can generally be replaced completely by a heat pump. This allows the energy requirement for a drying process to be reduced by 20% to 50% compared with a tumble dryer with an air to air heat exchanger and resistance heater.

A compressor heat pump generally operates optimally in defined temperature ranges in the evaporator and condenser. One problem when using a compressor heat pump in the condenser tumble dryer is the generally high temperature in the condenser, which as a result of the process can mean that the coolant can no longer be condensed or can no longer be condensed completely; the compressor must then be deactivated and/or a significantly poorer heat pump action must be taken into account. This problem becomes worse when the compressor is assisted by a supplementary heater in the process air circuit to achieve faster heating of the process air and therefore shorter drying times. Soiling of the air paths can also impede the circulating process air and therefore cause the temperature of the coolant to rise. Such operating states can cause damage to the heat pump or other parts of the tumble dryer and are therefore not permissible. It is therefore expedient to monitor the temperature in the heat pump circuit and particularly the components of the heat pump circuit.

In a conventional tumble dryer a non-permissible operating state, for example reduced circulation of the process air (air output reduction) is determined by detecting a temperature in the process air flow above a heater for the process air and before the drying chamber at regular intervals and forming a difference value from two successively detected values in each instance, said difference value corresponding to a time gradient. In a tumble dryer fitted with a heat pump (heat pump tumble dryer) such information generally does not have to be available in this form. For example in a heat pump tumble dryer the heat pump is frequently further from the drying chamber than the heater in a conventional condenser tumble dryer. In any case, it is not possible to identify a non-permissible operating state accurately in this manner in a condenser tumble dryer fitted with a heat pump.

DE 197 28 197 A1 discloses a method for identifying non-permissible operating states in a laundry dryer as well as a corresponding laundry dryer. The method aims to make it possible to detect different operating states involving too high a temperature and originating from different regions separately or together. The temperature is periodically detected in the air inflow above an air inflow heater and before the laundry drum, a difference value or gradient is formed from two successively detected values and this difference value (gradient) is compared with a predetermined difference value (gradient). A count value is increased by one step if the newly formed difference value is greater in absolute terms than the predetermined difference value and this count value is compared with a predetermined count value. If the current count value is greater than the predetermined count value, the heater of the laundry dryer is deactivated and/or an operating state display is activated.

WO 2008/086933 A1 discloses a condenser tumble dryer with a drying chamber, a process air circuit, in which a heater for heating the process air is located and the heated process air can be conducted by means of a blower over the articles to be dried, an air to air heat exchanger and a heat pump circuit with an evaporator, a compressor and a condenser. Located in the heat pump circuit between condenser and evaporator is an additional heat exchanger, which is functionally coupled to the air to air heat exchanger. The temperature of the coolant of the heat pump, in particular in the condenser, is kept within the permissible range by controlling the heat pump and additional heat exchanger. Temperature probes are also used to regulate the temperature of coolant or heat pump and the temperature of the process air in the heat pump circuit and/or in the process air circuit.

EP 1 593 770 A2 describes a laundry dryer with a drying chamber, a heat pump mechanism, in which a coolant can circulate between a heat absorber, a compressor, a throttle unit and a heat emitter, and an air circulation path for the circulation of drying air from the drying chamber through the heat absorber and the heat emitter back to the drying chamber. An air discharge part is arranged in the air circulation path between the drying chamber and the heat absorber so that some of the drying air flowing through the air circulation path from the drying chamber to the heat absorber is conveyed out through the air removal part. In the embodiment of the laundry dryer shown in FIG. 10 of the document the temperature of the coolant is measured and regulated such that it remains within a predetermined range.

WO 2010/012723 A1 therefore describes a condenser tumble dryer with a drying chamber for articles to be dried, a process air circuit, a first blower in the process air circuit, a heat pump, in which a coolant circulates, with an evaporator, a compressor, a condenser and a throttle unit, as well as a temperature probe for measuring a temperature of the coolant, and a controller, the condenser tumble dryer comprising first means for determining a temperature difference $\Delta T=(T_K^1-T_K^2)$ between a first temperature $T_K^1$ of the coolant and a second temperature $T_K^2$ of the coolant measured after a time period $\Delta t_1$ and for comparing $\Delta T$ with a limit temperature difference $\Delta T_K^{lim}$ stored in the controller, a counting apparatus for determining a number n of instances in which $\Delta T$ is greater than or equal to $\Delta T_K^{lim}$, and second means for comparing the number n with a predetermined limit number $n_{lim}$ stored in the controller and for evaluating the difference $\Delta n=(n-n_{lim})$ in respect of the presence of a non-permissible operating state.

DE 10 2010 000 427 A1 described an automatic laundry dryer for drying laundry after a drying work cycle, having: a rotating drum enclosing a drying chamber; an air supply system, which is connected for flow purposes to the drying chamber and supplies/removes air thereto/from; a heating system which can be used to heat air to be supplied by the air supply system; an output system for outputting treatment chemicals of a defined type and in a defined quantity; an imaging facility which can be used to output image data representing the drying chamber; and a controller, which is operationally connected to the air supply, heating and output systems as well as the imaging facility and is set up to determine the presence of articles to be dried in the drying chamber and to control the operation of the tumble dryer based on the presence of the articles to be dried. The imaging facility can be a thermal imaging facility, which can detect radiation in the IR range of the electromagnetic spectrum, the imaging facility being arranged on the rear or front frame or in the door.

DE 10 2005 055 411 A1 describes a dryer for drying at least one object, the dryer having: a dryer housing, in which a drying compartment is provided for holding the at least one object, in particular a heater for heating the drying compartment, an infrared-sensitive measuring element for contactless spectroscopic measurement of the surface temperature of the object provided in the drying compartment and for outputting a surface temperature signal, and a control arrangement with a first control facility for receiving the surface temperature signal from the infrared-sensitive measuring element and in particular a second control facility for controlling or regulating the heater, the control arrangement concluding a degree of moisture of the at least one object from at least the surface temperature signal.

WO 2001/046509 A1 describes an appliance for treating textiles with a facility for identifying properties of a textile, the facility comprising at least one transmit element and at least one receive element for transmitting and receiving electromagnetic radiation as well as an evaluation circuit connected to the receive element, it being possible for the radiation transmitted by the transmit element and reflected and/or transmitted by the textile to be received by the receive element and to be evaluated in the evaluation circuit.

Against this background it was the object of the invention to provide a condenser tumble dryer and a method for its operation, with which the temperature of the components of the tumble dryer can be monitored in a simple manner to optimize the control of the tumble dryer and therefore in particular also to improve the progress of a drying program. The invention is intended in particular also to be suitable for a condenser tumble dryer with a heat pump, so that it is preferably possible to control the components of a heat pump in such a manner as to optimize the progress of a drying program in a heat pump tumble dryer. It should also preferably be possible to be able to identify a non-permissible operating state that can be identified in principle from relatively high temperatures in the laundry dryer in a simple manner.

According to the invention said object is achieved by a condenser tumble dryer and a method with the features of the corresponding independent claim. Preferred embodiments of the inventive condenser tumble dryer and inventive method are set out in corresponding dependent claims. Preferred embodiments of the inventive method correspond to preferred embodiments of the inventive condenser tumble dryer and vice versa even if not explicitly stated here.

The subject matter of the invention is therefore a condenser tumble dryer with a drum for articles to be dried, a drive motor for the drum, a process air duct, a process air blower, a heating and cooling system for the process air, a temperature sensor and a control facility. In said condenser tumble dryer the temperature sensor is an infrared telescope arranged for the simultaneous measurement of thermal radiation from at least two components of the condenser tumble dryer which are to be monitored.

Simultaneous measurement of thermal radiation from at least three and even more preferably at least four components is preferably performed. The "process air duct" component here can be subdivided into a number of separate segments which are to be monitored here.

As part of a development of the inventive condenser tumble dryer the components which are to be monitored are selected from the group comprising an outer surface of the drum, the process air duct, the components of the heating and cooling system, the process air blower and the drive motor.

As part of a further development of the inventive condenser tumble dryer the infrared telescope contains a thermopile array.

A thermopile array here is an arrangement of thermopiles, also referred to as "thermocolumns", which convert thermal energy to electrical energy. A thermopile generally consists of a number of thermoelements, which are connected thermally in parallel and electrically in series, with the result that the generally low thermovoltages add up. The thermopile array is directed into the interior of the dryer and receives the IR radiation emitted from the components. The thermopile array is advantageously covered with silicon, which is also IR radiation-permeable, provided with a vacuum-tight seal and not exposed to ambient conditions such as deposits of moisture or steam, etc. A thermopile is advantageously in particular a membrane formed by the thinning of a semiconductor region with conductor paths of materials with different Seebeck coefficients which make contact on the membrane and are covered with an absorbent material that absorbs IR radiation. Incoming IR radiation heats the absorbent material and therefore the contact region of the conductor paths on the membrane so that a measurement signal in the form of a thermovoltage is obtained. Such a membrane allows effective thermal insulation from the bulk material of the thermopile array and therefore a clear, high measurement signal.

It is particularly preferable for an imaging lens to be provided before the infrared telescope, in particular thermopile array, in the inventive condenser tumble dryer to generate an image of a respective measurement point of each of the components to be monitored on the sensor field of the infrared telescope, in particular the thermopile array itself. This takes account of the fact that it is frequently advantageous not to measure all the radiation from a component but just the radiation at defined, previously specified, so-called measurement points. Even more preferably each measurement point here comprises a coating which has a predetermined emission coefficient for thermal radiation. This is a generally preferred measure if it is to be insured that temperature measurements of the infrared telescope are comparable at different measurement points regardless of their detailed manifestation, in view of the fact that different materials emit different intensities of infrared radiation at the same temperatures due to different associated emission coefficients. The emission coefficient of such a coating can be specifically set more easily, allowing improved measurement by the thermopile array. According to the invention therefore it is particularly preferably for the measurement point on the component to comprise a coating which allows the setting of a predetermined thermal radiation emission coefficient for the component.

The imaging lens is in particular a passive optical system, which on the one hand allows a diaphragm function for alignment with just the selected components and prevents interference radiation and preferably also provides optical alignment or bundling for signal amplification. The passive optical system can also allow optical windows of relevant wavelength ranges of the infrared radiation to be determined, in which for example the thermal radiation emitted by the components or the measurement points of the components does not or only insignificantly absorbs moisture in the dryer. Different optical windows can be determined for a main measurement and a reference measurement.

It is deemed particularly favorable for a respective thermopile of the thermopile array to be assigned to each component to be monitored in the condenser tumble dryer so that the thermal radiation from the respective component to be monitored is measured by the respective assigned thermopile. The same applies to an infrared telescope operating with different sensor technology, wherein a respective other sensor is to be taken into consideration and provided instead of a respective individual thermopile.

In one preferred embodiment of the condenser tumble dryer the control facility is set up to evaluate the thermal radiation, i.e. IR radiation, measured in each instance by the infrared telescope for the components, for the monitoring and/or control of the condenser tumble dryer, in particular of its components, such as the process air blower.

The values of the measured IR radiation can be evaluated directly by the control facility in the tumble dryer or they can first be converted to temperatures. In any case the relationships of essence for the monitoring and/or control of the tumble dryer, between on the one hand the values of the measured IR radiation or the temperatures determined therefrom and on the other hand the actions to be undertaken for defined values at components or their settings, e.g. rotation speed of the process air blower or the drum, are generally stored in the control facility.

Corresponding empirical values or calibration measurements can be used to this end. A calibration measurement or reference measurement can also advantageously be performed with a reference object in the tumble dryer so that specific errors or deviations of the specifically used thermopile array or its thermopiles can also be taken into account and changes can be made in subsequent calculations in relation to said reference measurement, for example at different drying compartment temperatures.

The term "actions" here can include a notification on a display apparatus that defined temperatures are outside a permissible range and indicate a non-permissible operating state or at least non-optimized progress of a drying program.

In one preferred embodiment of the condenser tumble dryer the heating and cooling system for the process air contains components in the form of a heat pump with an evaporator, a compressor, a condenser and a throttle unit. It is again preferable here for the components, the thermal radiation from which is measured by the infrared telescope, to comprise the evaporator, the compressor, the condenser and/or the throttle unit. The components, the thermal radiation from which is measured by the infrared telescope, then particularly preferably comprise the condenser and the compressor. The throttle unit can be in particular an expansion valve (also referred to as a throttle valve), a capillary or a diaphragm.

In preferred embodiments of the condenser tumble dryer, in which it contains a heat pump, the compressor can be such with a fixed output, which can thus be regulated only by switching on and off, or it can be a variable-output compressor. The compressor is preferably a variable-output compressor. The variable-output compressor can then be operated with an output P as a function of the measurement values of the infrared telescope so that the temperature of a coolant in the heat pump circuit is within a range $T_{KM}^1 \leq T_{KM} \leq T_{KM}^2$. It is also possible to measure a temperature $T_R$ in the installation location AR here using a temperature sensor $S^T_{AR}$, optionally using the thermopile array itself, and take it into account for the control of the variable-output compressor.

In embodiments of the invention, in which a heat pump with a variable-output compressor is used, a speed-regulated compressor is preferably used, its rotational speed $\omega_K$ varying as a function of the measurement values of the infrared telescope and optionally the temperature $T_R$ measured in some embodiments.

In the present invention a rotational speed $\omega_K$ of a variable-speed compressor is preferably varied as a function of the measured temperature $T_R$ based on a relationship between the rotational speed $\omega_K$ and the measured temperature $T_R$ stored in control unit, the rotational speed $\omega_K$ decreasing as the temperature $T_R$ increases.

The compressor used in embodiments of the inventive tumble dryer is not particularly restricted. Suitable compressors include for example screw compressors and rotating piston compressors. According to the invention the compressor used is preferably a rotating piston compressor.

The components to be monitored by means of the infrared telescope must be located in the field of view of the infrared telescope, "field of view" being interpreted broadly. In some instances it can be extended by the presence of an imaging lens, which can be directed onto the space to be monitored and conducts the thermal radiation from the component on in a suitable manner.

According to the invention it is preferable for each component to be assigned an individual sensor of the infrared telescope so that the thermal radiation from the respective component is measured by the assigned sensor.

In a further preferred embodiment of the inventive condenser tumble dryer the infrared telescope is arranged so that it measures thermal radiation from the outer drum surface, in other words from the drum casing. This allows the tracking of a drying program and in particular of degrees of moisture reached in the laundry articles to be dried.

A condenser tumble dryer is also preferred, in which the control facility is set up to take into account different degrees of emission of the components. As mentioned above the degrees of emission can be set by suitable selection and configuration of the measurement points to some extent. Use is generally made here of the fact that metal surfaces only have a very low emission coefficient while the emission coefficient of other materials is generally higher.

In a further preferred embodiment of the condenser tumble dryer respective maximum permissible values for the thermal radiation from the components to be monitored are stored in the control facility and the control facility is set up to deactivate the condenser tumble dryer if a maximum permissible value for the thermal radiation from the components is exceeded and/or to display that the maximum permissible value is exceeded on a display apparatus of the condenser tumble dryer.

Specifically the inventive condenser tumble dryer preferably has an acoustic and/or optical display means for displaying an operating state, e.g. a non-permissible operating state. An optical display means can be for example a liquid crystal display, on which defined requests or notifications are shown. Light-emitting diodes can also or alternatively light up in one or more colors. The nature of the display of an operating state can be a function of the nature of the operating state, e.g. permissible or non-permissible.

For example in the case of a generally less critical first non-permissible operating state a request to clean the air paths in the condenser tumble dryer could be shown on a liquid crystal display. Alternatively or additionally hereto a light-emitting diode could light up, for example in the color orange.

In the case of a second non-permissible operating state, which is generally critical, a notification that the drying process has been interrupted, the coolant circuit should be checked and/or a service technician should be called is shown on a liquid crystal display. Alternatively or additionally hereto a light-emitting diode could light up, for example in the color red.

The display could also take place acoustically, with different non-permissible operating states being indicated by different beeps.

The display is however not limited to a display of non-permissible operating states. As well as showing information relating generally to a drying program, e.g. remaining drying time, it could also be displayed whether or to what extent the coolant temperature is within an optimum range.

In embodiments of the inventive condenser tumble dryer, in which it is fitted with a heat pump, an additional heat exchanger can advantageously be arranged in the heat pump. In one preferred embodiment the additional heat exchanger is arranged in a process air duct between the evaporator and the condenser. In an alternative preferred embodiment the additional heat exchanger is arranged in a cooling air duct. An air to air heat exchanger is preferably arranged in said cooling air duct.

The inventive condenser tumble dryer also preferably comprises a second blower for cooling the heat pump circuit. The second blower is preferably arranged in a cooling air duct and/or the surroundings of the compressor.

In the embodiment as heat pump tumble dryer the process air can only be heated by way of the condenser of the heat pump. However an electric heater can also be additionally used.

If a further heater is used in the inventive condenser tumble dryer in addition to the heat pump, it is preferably a two-stage heater. In a preferred embodiment of the invention control of said heater is also used to regulate the temperature of the coolant.

If present, a cooling apparatus for the heat pump can be used to regulate the temperature of the coolant of the heat pump, preferably comprising a second blower. The second blower can be used directly to cool components of the heat pump, in particular the compressor. However the second blower and an additional heat exchanger are preferably arranged in a cooling air duct, with the additional heat exchanger being located in the heat pump. A further air to air heat exchanger can also be located in the cooling air duct. The air to air heat exchanger, if present, is preferably removable. This is particularly advantageous as it is easier to remove lint from a removable heat exchanger.

As the energy required for drying decreases as the degree of drying of the articles to be dried in the condenser tumble dryer increases, it is expedient to regulate the heater correspondingly, in other words, to reduce its heat output as the degree of drying increases, in order to maintain an equilibrium between the drying energy supplied and required.

As the degree of drying of the articles to be dried, in particular laundry articles, increases, in embodiments of the tumble dryer with a heat pump a smaller heat output or even an increasing cooling output is required from the heat pump. The temperature in the process air duct would in particular rise significantly after the end of a drying phase. Generally therefore the heat pump, and optionally an additional heater in the condenser tumble dryer, is regulated in such a manner that a maximum permissible temperature is not exceeded in the drum.

The subject matter of the invention is also a method for operating a condenser tumble dryer with a drum for articles to be dried, a drive motor for the drum, a process air duct, a process air blower, a heating and cooling system for the process air, a temperature sensor and a control facility. The temperature sensor here is an infrared telescope arranged for the simultaneous measurement of thermal radiation from at least two components of the condenser tumble dryer which are to be monitored, the thermal radiation from the at least two components to be monitored being measured by means of the infrared telescope and being evaluated by the control facility in respect of the respective temperature of the components which are to be monitored and being used for monitoring and/or control during operation of the condenser tumble dryer.

In one preferred embodiment of the inventive method the components comprise the components of the heating and cooling system, the components, the thermal radiation from which is measured by the infrared telescope, comprising the evaporator, the compressor, the condenser and/or the throttle unit of a heat pump and the condenser tumble dryer being controlled in such a manner that the temperature of the coolant is within a predetermined range. The predetermined range here is a function in particular of the nature of the coolant.

According to the invention a method is preferred in which the condenser tumble dryer is controlled by varying the output of a variable-output compressor such that the temperature of the coolant is within a predetermined range.

In embodiments of the inventive method, in which the infrared telescope measures the thermal radiation from the outer drum surface, a drying program operating in the condenser tumble dryer can be monitored more effectively in respect of the moisture in the laundry articles in the drum. The quantity of the load of laundry articles can also preferably be taken into account here, by storing a relationship between thermal radiation or the temperature of the outer drum surface and the degree of moisture in the laundry items for different load quantities in the control facility.

The invention has numerous advantages. It allows central monitoring of the temperatures of the individual components of a condenser tumble dryer, e.g. of a heat pump tumble dryer. A single, universally operating, temperature sensor, specifically an infrared telescope, is used, instead of generally a plurality of individual temperature sensors arranged at different points in the condenser tumble dryer. In embodiments of the invention as a heat pump tumble dryer information can be obtained about the temperature of evaporator, condenser, compressor and throttle unit and the pipes in the heat pump connecting them, so that the heat pump and therefore the condenser tumble dryer can be controlled more effectively. In embodiments of the invention in which a variable-output compressor is used, the output of the compressor can be varied specifically so that the heat pump can operate in an optimum temperature range. This allows operation of the condenser tumble dryer with a particularly favorable energy balance sheet. The pump is also conserved. Similar advantages also result when the tumble dryer contains an electric heater or gas heater and an air to air heat exchanger instead of a heat pump. Central monitoring of the temperature of the individual components is advantageous here too.

The progress of a drying program and therefore the setting of a laundry moisture content can also be tracked and controlled by evaluating the thermal radiation from the drum casing, i.e. the outer drum surface. The invention also illustrates the use of an intelligent system or of infrared technology and therefore ultimately a high level of innovation of the inventive tumble dryer.

The operation of a condenser tumble dryer can also be monitored in a simple and effective manner. Non-permissible operating states can be displayed reliably so that appropriate countermeasures can be implemented.

Figure 2:
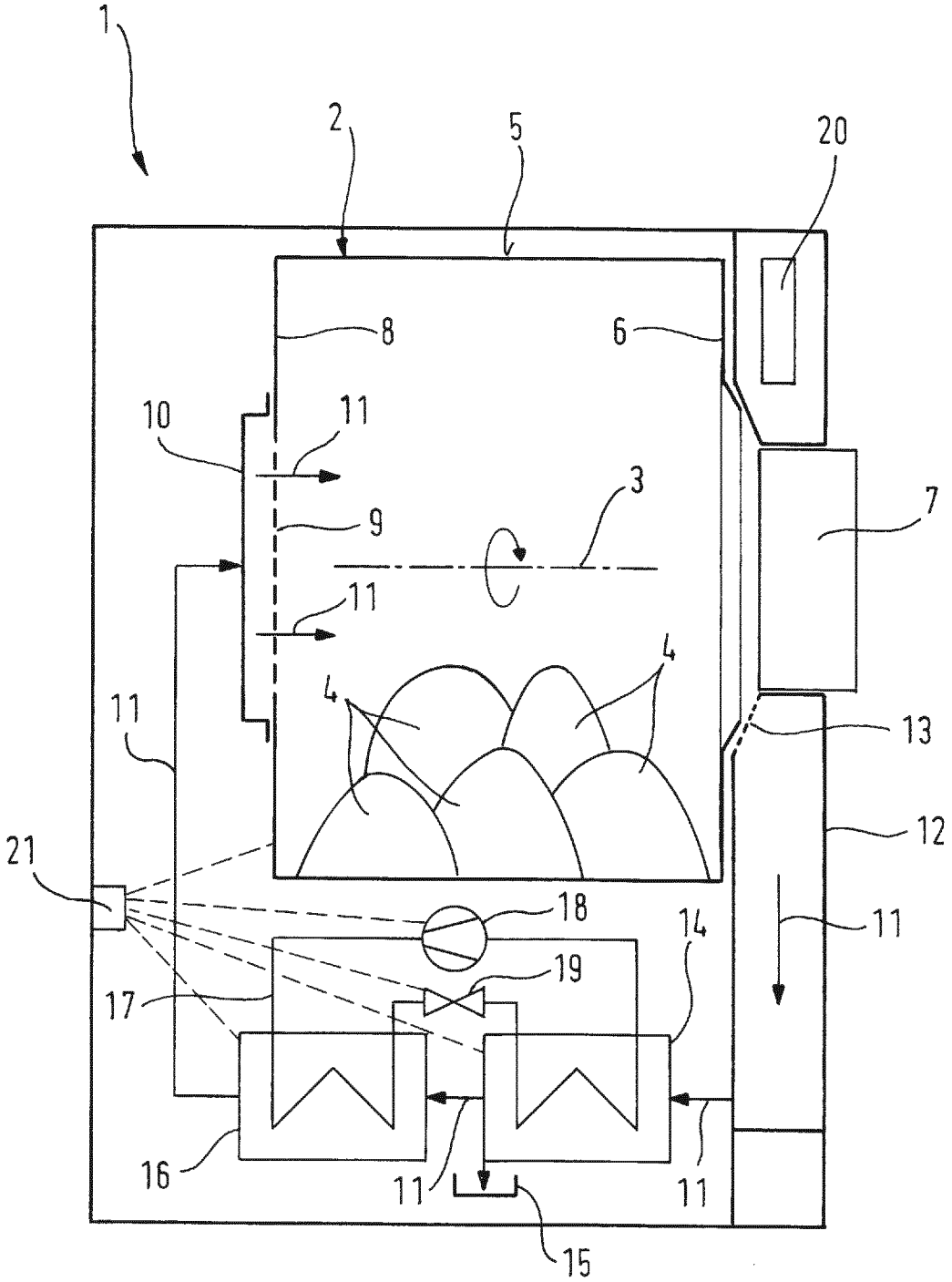
Figure 3:
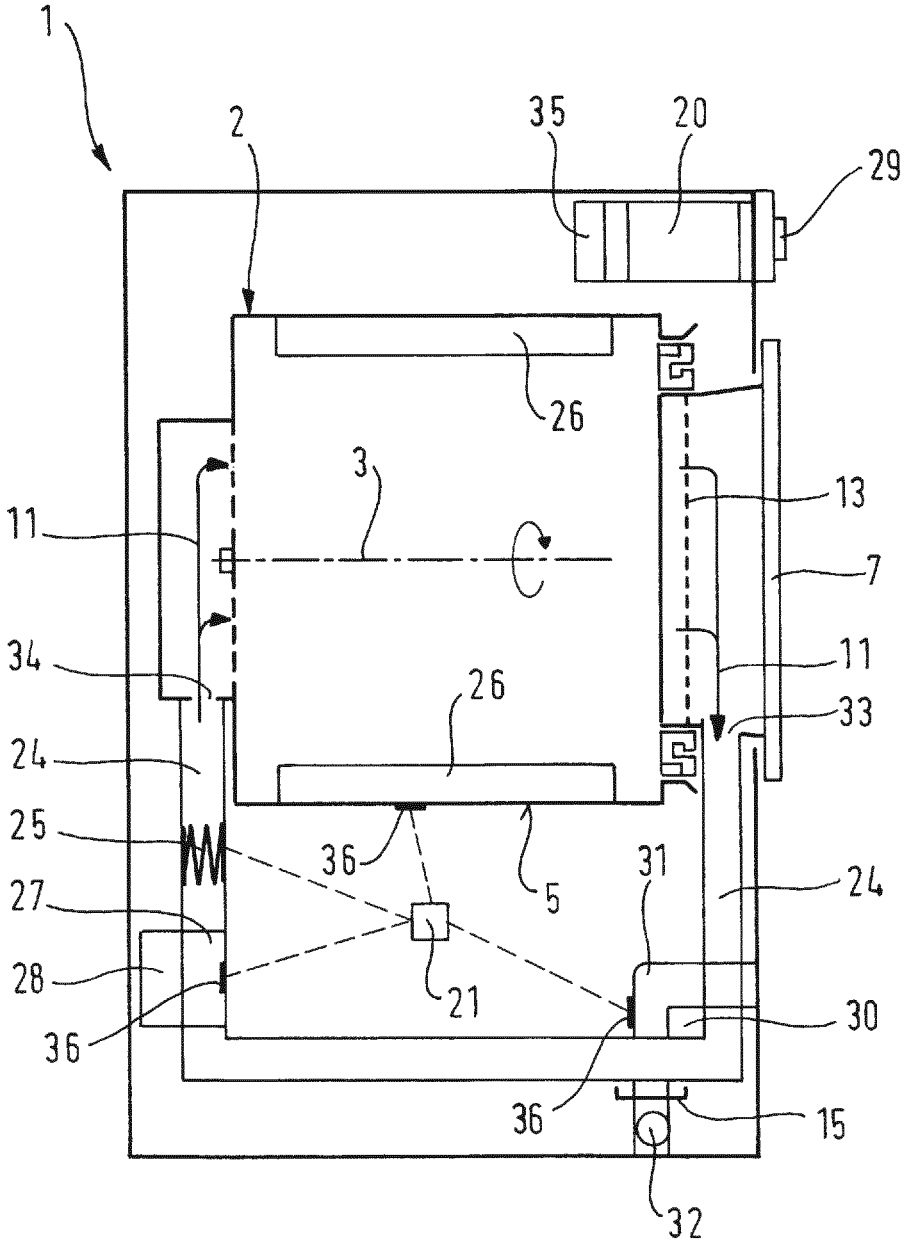

Further details of the invention will emerge from the description which follows of non-restricting exemplary embodiments of the inventive condenser tumble dryer and a method employing said condenser tumble dryer. Reference is made here to FIGS. 1 to 3, in which:

FIG. 1 shows a perspective view of the parts of a condenser tumble dryer that are of essence to the invention according to a first embodiment, in this instance a heat pump tumble dryer, FIG. 2 shows a vertical section through a condenser tumble dryer according to a second embodiment, in this instance also a heat pump tumble dryer, FIG. 3 shows a vertical section through a condenser tumble dryer according to a third embodiment, configured as a condenser tumble dryer with an air to air heat exchanger.

FIG. 1 shows a perspective view of the parts of a condenser tumble dryer that are of essence to the invention according to a first embodiment, which is a heat pump tumble dryer 1.

FIG. 1 shows the drum 2 with an outer drum surface 5 and the components of a heat pump, i.e. an evaporator 14, a condenser 16, a compressor 18 and the pipes 23 connecting them. A thermopile array 21 is arranged in such a manner that the thermal radiation from the components of the heat pump and also the drum 2 can be received. The field of view or detection range for paths 22 of the thermal radiation from the components of the tumble dryer to the infrared telescope 21 is shown here by an ellipse marked with a broken line.

The infrared telescope 21 here comprises a thermopile array 21 and an imaging lens positioned before it, the latter not being shown for reasons of clarity. Said lens can have a focal length of several millimeters to a few centimeters and the thermopile array 21 is in its focal plane. This allows an image of the surroundings of the infrared telescope 21 to be generated on the thermopile array 21 so that different thermopiles therein measure temperatures at different sites in the laundry dryer 1. It goes without saying that a different infrared sensor system with an extensive surface can replace the thermopile array 21.

FIG. 2 shows a vertical section through a condenser tumble dryer according to a second embodiment, in this instance a heat pump tumble dryer. The condenser tumble dryer 1 has a cylindrical laundry drum 2, which can be rotated about an essentially horizontally aligned (rotation) axis 3 and in which laundry articles 4 are present, which are in particular to be dried in the condenser tumble dryer 1.

The drum 2 is made of stainless steel and has a cylindrical casing with a cylindrical outer drum surface 5. The cylindrical casing supports agitators (not shown here), which are to help raise the laundry articles 4. Adjoining the casing at the front of the laundry drum 2 is a circular front facing wall, through which the laundry articles 4 can be introduced into the drum 2. The corresponding opening in the front facing wall 6 is closed by a door 7. Adjoining the casing at the rear of the laundry drum 2 is a circular rear facing wall 8, which has perforations 9. Bearings and seals, against or on which the drum 2 rests or which seal it from its surroundings, are not shown here. The perforations 9 are covered by a hood 10 at the rear of the laundry drum 2. A drive motor for the drum, which is generally present, is not shown for the sake of clarity.

A flow of process air 11 conducted in the essentially closed process air duct and driven by a process air blower (not shown here) passes into the drum 2 and reaches the laundry items 4 contained therein and moved by rotation of the drum 2. The process air 11 passes through the hood 10 and the perforations 9 into the drum 2 to flow round the laundry articles 4 there and extract moisture therefrom. In the region of the door 7 the process air 11 passes out of the drum 2 into the process air duct in the bearing plate 12 where it flows through a lint filter 13 which traps fibers and other fine particles (generally referred to as lint) that the process air 11 has drawn out of the laundry articles 4. Below the drum 2 the process air 11 exits from the bearing plate 12 again and passes to the evaporator 14 of a heat pump. Heat is extracted from the moist warm process air there so that the moisture extracted from the damp laundry items 4 and contained therein condenses and can be discharged as liquid condensate. The condensate is collected in a condensate tray 15 and generally conducted to a condensate container (not shown here) which can be emptied to dispose of the condensate. Behind the evaporator 14 the process air 11, from which moisture has now been extracted, passes into the condenser 16 of the heat pump where it is heated again and thus made ready to absorb further moisture from the laundry articles 4. Behind the condenser 16 the process air passes back into the hood 10 and the drum 2.

In the heat pump a coolant, which circulates in a closed coolant circuit 17 and some of which is supplied to the evaporator 14 in liquid form, evaporates, extracting heat from the moist warm process air 11 flowing through. The evaporated coolant is then compressed by a compressor 18, being heated in the process, and then passes into the condenser 16. In the condenser 16 the coolant returns the heat absorbed in the evaporator 14 to the process air flowing through. Behind the condenser 16 the condensed coolant passes back through a throttle unit 19, which reduces its internal pressure and temperature, to the evaporator 14 to be evaporated again, thereby absorbing heat. The coolant is generally a short-chain fluorinated hydrocarbon or a mixture of such substances, in particular for example the substances known in this context R134a and R407C. Propane, generally referred to as R290, is also a possible coolant. The compressor 18 here is a variable-output compressor, the output of which can be adjusted based on the temperature of the components of the heat pump measured by the thermopile array 21 and therefore the temperature of the coolant in order to keep the temperature of the coolant within an optimum range.

A control facility 20 controls all the functions of the condenser tumble dryer 1. To this end it receives the thermal radiation values measured by the thermopiles of the thermopile array 21 for each component and activates corresponding actuators, in particular the drive motor of the drum 2, the process air blower for the process air 11 and the compressor 18. The thermopile array 21 is arranged in such a manner that it can measure the thermal radiation (shown with a broken line) from the outer drum casing 5, as well as from the compressor 18, throttle unit 19, evaporator 14 and condenser 16. A shared lens positioned in front is not shown here.

As the emission coefficient for thermal radiation is below 10% for stainless steel, thermal radiation from defined measurement points (not shown in detail here) is preferably measured, preferably from one measurement point per measured component. To this end the point can be provided with a suitable coating that increases thermal radiation. The shared lens then has the task of conducting the thermal radiation originating from the measurement point specifically to a thermopile of the thermopile array 21. The thermal radiation value measured by the thermopile can then be supplied to the control facility 20 for evaluation.

FIG. 3 shows a vertical section through a condenser tumble dryer according to a third embodiment, configured as a condenser tumble dryer with an air to air heat exchanger.

The condenser tumble dryer 1 shown in FIG. 3 has a drum 2, which can be rotated about a horizontal axis 3, for holding laundry articles to be dried (not shown here), agitators 26 for moving laundry articles during a drum rotation being positioned therein. The process air 11 is conducted through the drum 2 in the process air duct 24 by means of a process air blower 27 by way of an air to air heat exchanger 30 and an electric heater 25. In this process, process air 11 heated by the electric heater 25 is conducted through the drum entrance 34 from the rear, in other words from a side of the drum 2 opposite a door 7, through its perforated base into the drum 2.

After leaving the drum 2, the moisture-laden process air 11 flows through the fill opening of the drum 2 by way of a lint filter 13 within the door 7 closing the fill opening. The flow of process air 11 in the door 7 is then deflected downward through the drum exit 33 into the process air duct 24 and conducted to the air to air heat exchanger 30, through which cooling air can be conveyed in a cooling air duct 31 by means of a cooling air blower 32. In the air to air heat exchanger 30 cooling causes a variable proportion of the moisture absorbed from the laundry articles by the process air to condense and be collected in a condensate tray 15.

The condenser tumble dryer 1 is controlled by way of a program controller 20, which can be operated by the user by way of an operating unit 29. In the condenser tumble dryer 1 illustrated here a thermopile array 21 is arranged in such a manner that it can detect and therefore measure the thermal radiation from measurement points 36 on the outer drum surface 5, the air to air heat exchanger 30, the process air blower 27 and the electric heating apparatus 25. These measurement values are supplied to the control facility 20 for evaluation and the possible prompting of further steps. After evaluating the measured thermal radiation the control unit 20 can control for example the electric heating apparatus 25, the drive motor 28, the process air blower 27 and/or the cooling air blower 32 in such a manner that a drying program operates optimally and a predetermined laundry moisture content for example is reached.

In the third embodiment shown in FIG. 3 the process air blower 27 and the drum 2 are driven by the drive motor 28. In this embodiment the drive motor 28 is a brushless direct current motor (BLDC). The drum 2 is stepped down significantly, for example with a 1:55 ratio, while the process air blower 27 is not stepped down but driven by the drive motor 28 with a rotational speed ratio of 1:1.

In the condenser tumble dryer 1 each component 25, 30 is assigned a thermopile of the thermopile array 21 so that the thermal radiation from the respective component is measured by the assigned thermopile. In the illustrated embodiment the thermopile array 21 is arranged so that it can measure thermal radiation from the outer drum surface 5. The control facility 20 is set up to take into account different degrees of emission of the components 25, 30.

Finally in this embodiment of the condenser tumble dryer 1 maximum permissible values for the thermal radiation from the components 25, 30 are stored in the control facility 20 and the control facility 20 is set up to deactivate the condenser tumble dryer 1 if a permissible value for the thermal radiation from the components 25, 30 is exceeded and to display that the maximum permissible value is exceeded on a display apparatus 35 of the condenser tumble dryer 1.

LIST OF REFERENCE CHARACTERS

1 Condenser tumble dryer
2 Drum (for holding laundry articles to be dried)
3 Rotation axis
4 Laundry articles
5 Drum casing, outer drum surface
6 Front facing wall
7 Door
8 Rear facing wall
9 Perforation
10 Hood
11 Process air
12 Bearing plate
13 Lint filter
14 Evaporator
15 Condensate tray

16 Condenser
17 Coolant circuit
18 Compressor
19 Throttle unit
20 Control facility
21 Thermopile array (comprising a number of thermopiles)
22 Path of thermal radiation from components to thermopile array
23 Pipes between evaporator, condenser, compressor and throttle unit
24 Process air duct
25 Electric heating apparatus
26 Agitator
27 Process air blower
28 Drive motor; e.g. variable-speed drive motor, in particular BLDC motor
29 Operating unit
30 Air to air heat exchanger
31 Cooling air duct
32 Cooling air blower
33 Drum exit
34 Drum entrance
35 Optical display apparatus
36 Measurement points

The invention claimed is:

1. A condenser tumble dryer with a drum for articles to be dried, a drive motor for the drum, a process air duct, a process air blower, a heating and cooling system for process air, a temperature sensor and a control facility, wherein the temperature sensor is arranged for the simultaneous measurement of thermal radiation from at least two components of the condenser tumble dryer which are to be monitored, at least one of the two components including at least one component of the heating and cooling system;

the temperature sensor has an infrared telescope with a sensor array and an imaging lens for generating an image of a respective measurement point of each of the components to be monitored on a thermopile array; and the control facility is set up to evaluate the thermal radiation measured in each instance by the infrared telescope for the components to be monitored, for the monitoring and control of the condenser tumble dryer.

2. The condenser tumble dryer as claimed in claim 1, wherein the components which are to be monitored are selected from the group further include an outer surface of the drum, the process air duct, different components of the heating and cooling system, the process air blower and the drive motor.

3. The condenser tumble dryer as claimed in claim 1, wherein each said measurement point comprises a coating, which has a predetermined thermal radiation emission coefficient.

4. The condenser tumble dryer as claimed in claim 1, wherein the infrared telescope contains the thermopile array.

5. The condenser tumble dryer as claimed in claim 4, wherein a respective thermopile of the thermopile array is assigned to each component to be monitored so that the thermal radiation from the respective component to be monitored is measured by the respective assigned thermopile.

6. The condenser tumble dryer as claimed in claim 1, wherein the heating and cooling system for process air contains a heat pump with an evaporator, a compressor, a condenser and a throttle unit.

7. The condenser tumble dryer as claimed in claim 6, wherein the components to be monitored comprise the evaporator, the compressor, the condenser and/or the throttle unit.

8. The condenser tumble dryer as claimed in claim 7, wherein the components to be monitored comprise the condenser and the compressor.

9. The condenser tumble dryer as claimed in claim 6, wherein the compressor is a variable-output compressor.

10. The condenser tumble dryer as claimed in claim 1, wherein the components to be monitored comprise the outer drum surface.

11. The condenser tumble dryer as claimed in claim 1, wherein the control facility is set up to take into account different emission coefficients of the components to be monitored.

12. The condenser tumble dryer as claimed in claim 1, wherein respective maximum permissible values for the thermal radiation from the components to be monitored are stored in the control facility and the control facility is set up to deactivate the condenser tumble dryer if a maximum permissible value for the thermal radiation from the components to be monitored is exceeded and/or to display that the maximum permissible value is exceeded on a display apparatus of the condenser tumble dryer.

13. The method as claims in claim 1, wherein the temperature sensor is fixed at only a single location within the tumble dryer.

14. A method for operating a condenser tumble dryer with a drum for articles to be dried, a drive motor for the drum, a process air duct, a process air blower, a heating and cooling system for the process air, a temperature sensor and a control facility, wherein the temperature sensor is arranged for the simultaneous measurement of thermal radiation from at least two components of the condenser tumble dryer which are to be monitored, at least one of the two components including at least one component of the heating and cooling system;

the temperature sensor has an infrared telescope with a sensor array and an imaging lens for generating an image of a respective measurement point of each of the components to be monitored on a thermopile array; and the thermal radiation from the at least two components to be monitored is measured by means of the infrared telescope and evaluated by the control facility in respect of the respective temperature of the components which are to be monitored and used for monitoring and control during operation of the condenser tumble dryer.

15. The method as claimed in claim 14, wherein the components which are to be monitored comprise the components of the heating and cooling system, wherein the components, the thermal radiation from which is measured, comprise an evaporator, the compressor, the condenser and/or the throttle unit of a heat pump and the condenser tumble dryer is controlled in such a manner that the temperature of a coolant of the heat pump is within a predetermined range.

16. The method as claimed in claim 15, wherein the condenser tumble dryer is controlled in such a manner that the output of the compressor, which is a variable-output compressor, is varied such that the temperature of the coolant is within a predetermined range.

* * * * *